US007639161B2

(12) United States Patent
Sacristán

(10) Patent No.: US 7,639,161 B2
(45) Date of Patent: Dec. 29, 2009

(54) PORT MARKER

(75) Inventor: Álvaro Ortiz Sacristán, Barcelona (ES)

(73) Assignee: Arch Beach, S.L., Barcelona (ES)

( * ) Notice: Subject to any disclaimer, the term of this patent is extended or adjusted under 35 U.S.C. 154(b) by 341 days.

(21) Appl. No.: 11/794,959

(22) PCT Filed: Jan. 13, 2006

(86) PCT No.: PCT/ES2006/000010

§ 371 (c)(1),
(2), (4) Date: Jul. 10, 2007

(87) PCT Pub. No.: WO2006/089981

PCT Pub. Date: Aug. 31, 2006

(65) Prior Publication Data

US 2008/0002398 A1 Jan. 3, 2008

(30) Foreign Application Priority Data

Jan. 13, 2005 (ES) ..... 200500051

(51) Int. Cl.
*G08G 3/00* (2006.01)

(52) U.S. Cl. ..... 340/985; D26/67; 441/16; 362/802; 362/567; 398/1; 33/1 DD

(58) Field of Classification Search ..... 340/985; 441/16; 682/802, 567; 398/1; 33/1 DD; D26/67
See application file for complete search history.

(56) References Cited

U.S. PATENT DOCUMENTS

2005/0276067 A1* 12/2005 Risch et al. ..... 362/567

* cited by examiner

*Primary Examiner*—Benjamin C Lee
*Assistant Examiner*—Ojiako Nwugo
(74) *Attorney, Agent, or Firm*—The Nath Law Group; Jerald L. Meyer; Derek Richmond

(57) ABSTRACT

The invention relates to a port marker which comprises lighting means and which is intended to be positioned next to the red and green light signals, lighting columns or lighthouses at the port entrance. The inventive marker comprises a self-supporting half-ring having a maximum height which is essentially greater than the height of the light source of the lighting column, lighthouse or light signal. The invention also comprises and electronic unit for powering and controlling the lighting means. The lighting means are distributed between the two ends of the self-supporting half-ring along the length thereof and are disposed such as to be visible to a boat or similar vessel approaching the port. The color of said lighting means corresponds to that of the respective obligatory lighting column, lighthouse or light signal at the entrance to the port, which, as mentioned above, can be red or green.

10 Claims, 2 Drawing Sheets

PORT MARKER

TECHNICAL SECTOR OF THE INVENTION

This present invention relates to the technical sector of maritime navigation signalling markers. More specifically, the invention refers to a port marker of the type that has some means of lighting and makes the correct entry into the port easier.

BACKGROUND TO THE INVENTION

In the technical sector of maritime navigational markers, the use of the markers or illuminated signals at the entrance to ports is regulated. Normally the left edge of the port entrance is marked with a red light or lamp whilst the right edge is marked with a green light; in this way the navigator, on coming close to the port can make out one or both lights from a certain distance, and can steer the correct course for the vessel having an idea of the whereabouts of said mouth of the port entrance (to the right of the red light and to the left of the green light).

The rules that regulate this signalling code or signs were to a large degree set up at the end of the nineteenth century. Even though said code is still intrinsically valid these days, the circumstances of light pollution has drastically changed since then, especially in the ports of large cities in which there is a proliferation of leisure centres or places for night time entertainment, together with the signalling or lighting lights of the city, making the discrimination of the port entry lights difficult against the rest of the illuminated signs. If some adverse weather conditions are added to this light pollution (such as fog, rain, waves, etc.), the making out of the markers at the port entrance is even more complicated.

Even though the current navigation and steering devices allow the course of a vessel to be steered with great precision, many times without the need of the navigator for direct visibility, same prefer to have visual contact with possible obstacles and, in general, with the route to be followed by the vessel or with possible visual references for said route in the cases of low visibility. In addition, the electronic equipment that are concerned with making the navigation easier can fail or breakdown, especially in said extremely adverse weather conditions.

Because of all of this, the present invention has the aim to provide a support marker for the regulatory illuminated markers at the entrance to ports for the purpose of making their discrimination easier by navigators even in conditions of poor visibility. Differing forms of signalling lights are known for the mouth of port entrances even though in general the majority of these take the form of differing types of lamps. Nothing is known about any type of illuminated support signals, which, without needing a change in the current maritime regulations, helps the locating of the mouth of the port entrance with greater precision from long distances and/or in conditions of poor visibility.

An Explanation Of The Invention

For that purpose the aim of this present invention is a port marker aimed at being sited next to the red and green light signals, lighting columns or lighthouses at the port entrance, which is made up of a self-supporting arch, having a maximum height which is essentially greater than the height of the light source of the lighting column, lighthouse or light signal. The marker also comprises an electronic unit for powering and controlling the lighting means. The lighting means are distributed between the two ends of the self-supporting arch along the length thereof and are disposed such as to be visible to a boat or similar vessel approaching the port. The colour of said lighting means corresponds to that of the respective obligatory lighting column, lighthouse or light signal at the entrance to the port, which can be red or green.

According to another characteristic of the invention, the means of lighting are made up from a series of autonomous elements of consecutive lighting, and the electronic assembly of the arch is adapted to providing continuous lighting from said autonomous lighting elements and in a sequential lighting order of same from the element located furthest from the obligatory lighting column, lighthouse or light signal up to the element that is located furthest from the said obligatory lighting column, lighthouse or light signal.

In accordance with another characteristic of this present invention, said autonomous lighting elements are LEDs.

In accordance with yet another characteristic of this present invention, the electronic supply assembly consists of a series of solar panels, the lighting means being situated on the side of the arch that is visible on entering into the port, and the solar panels being located at least on the remaining faces, distributed along the length of the arch.

A further characteristic of this present invention consists of the self supporting arch being made up from autonomous modules, formed by the sections of the self supporting arch and consecutively connected, each one of which likewise constitute a corresponding autonomous lighting element.

One further characteristic of this present invention is that each autonomous element incorporates a matrix of LEDs on their front panels.

Another additional characteristic of this present invention is that each autonomous module incorporates solar panels on their upper faces.

And yet another characteristic of this present invention consists of the fact that the transversal section of the arch is quadrangular, at least in the area of the siting of the lighting means.

In accordance with another characteristic of this present invention the transversal section of the arch, is rectangular, at least in the area of the siting of the lighting means.

Finally, another characteristic of the present invention is that the material of the arch is made from stainless steel.

Experts in the technique will appreciate that the new and inventive characteristics of the invention of the marker of this present invention, in addition to providing a combined and effective solution to the problems previously outlined in the background section, they allow a marker to be obtained with a simple and resistant structure for the adverse outside conditions, which are typical in ports, with the following advantages from the point of view of clear and unmistakable signalling at the mouth of the entrance to the port even under conditions of low visibility. All of this without making compliance with the current maritime regulations more difficult in so far as that which refers to signalling.

A BRIEF DESCRIPTION OF THE DRAWINGS

The drawings attached, by way of example and without being by way of limitation, illustrate a form of carrying out the port marker object of the invention.

DETAILED DESCRIPTION OF THE DRAWINGS

Different forms of embodiments of the present invention can be appreciated in said drawings.

Figure 1:
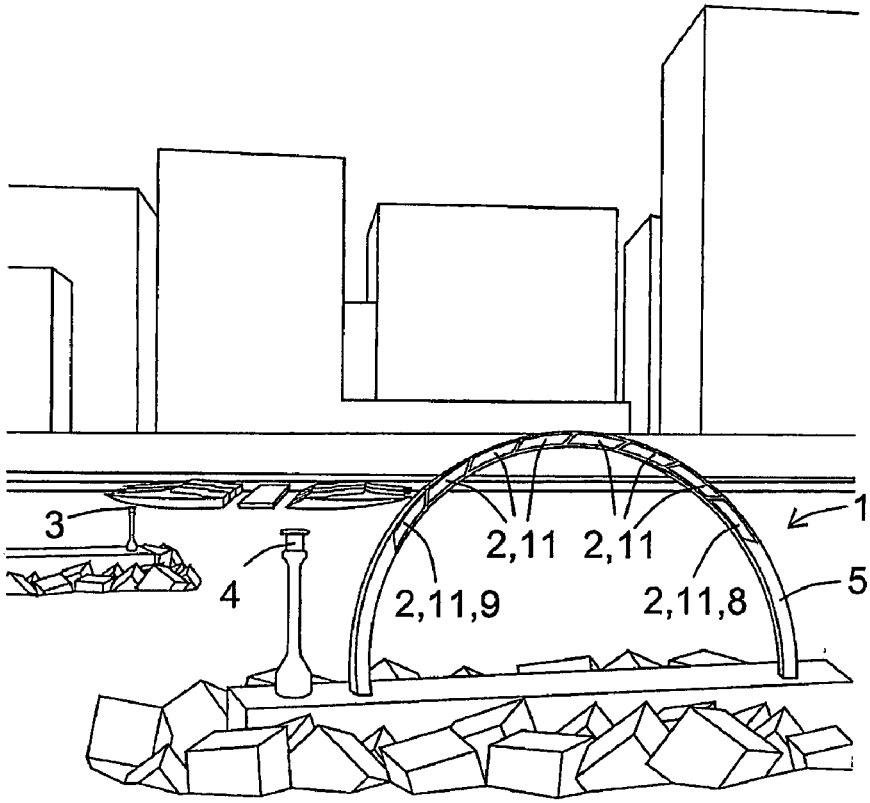
FIG. 1 is a perspective view of the mouth of the port entrance with the marker of the present invention installed next to one of the compulsory signalling lights.
Figure 2:
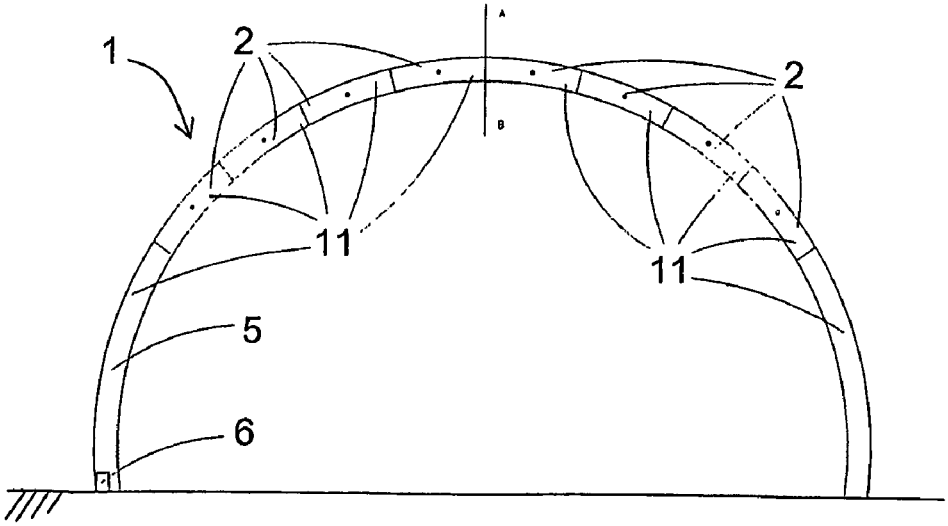
FIG. 2 is a schematic front view of an embodiment of the marker in the shape of an arch for the present invention.
Figure 3:
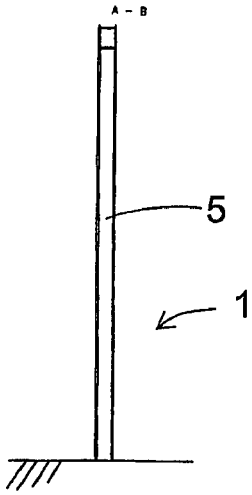
FIG. 3 is a section view of the embodiment of the marker of FIG. 2, across a line A-B.
Figure 4:
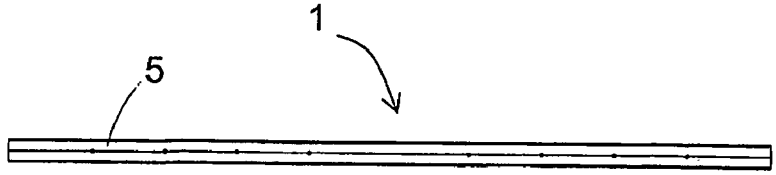
FIG. 4 is an upper view of an embodiment of the marker of FIG. 2.

Specifically in FIG. 1, the marker 1 of this present invention can be appreciated installed next to the green light 4 that marks the right side of the mouth of the port entrance. In the general view of the marker 1 in its working environment a very illustrative way of the use of the present invention is shown. In the first place, the arrangement of the red 3 and green 4 lights or lighting columns that mark out the port entrance must be highlighted. At the present time, this signalling 3 and 4 is that which is normally used by the ports, according to the regulations in force. Navigators who approach the port, after seeing said lights 3 and 4, can visually locate the mouth that gives access to said port and, consequently, can steer the bow of the boat to take the correct course of same. As and how commented previously, the problem that is produced with these types of signalling 3, 4, consists of the fact that in the present cities and, more specifically, the maritime ports of said cities, there is usually a very high level of light pollution (for example, due to nocturnal leisure installations located many times in the ports themselves), as a result of which, the navigator, from a certain distance, sees an enormous number of lights of differing colours (including the obligatory red and green ones) and it can take some considerable time until locating the relevant lights 3 and 4 in an exact manner. This situation can be made worse by adverse weather conditions, such as waves, fog, rain, snow, etc., in which case the visibility can become practically nil.

As can be appreciated from FIG. 1, the fact of having the marker 1 together with signalling light 4 makes an unmistakable indication of the situation of the latter. The navigator can see differing lighting sources for the city's nocturnal illumination but a green light source 4 together with an illuminated arch 5 that indicates the position of said green light 4 becomes almost final for the correct locating of the mouth of the entrance to the port. The shape chosen for the marker 1 is as a arch 5 as a marker 1 is being dealt with that is visible from relatively large distances, that has a geometric shape that is different to the rest of the luminous signals of the city and the structure of which will not be excessively complicated both in regard to its assembly and equally for the installation. The visibility of marker 1 with this arch shape 5 is guaranteed thanks to the fact that the highest part of the arch 5 can be located at any point compared to sea level in accordance with the criteria of the authorities in charge of port signalling. This means that the arch 5 can have an adapted curve and a length so that the luminous signal is located at a height that is sufficient for it to be seen even, for example, with high waves. On the other hand, the shape of the illuminated arch 5 has a geometric shape that is not very usual in terms of city lighting and so reducing the possibility of it being confused with other nearby signals. Finally, said arch shape 5 is sufficiently simple so as to be able to be handled, transported and installed without great difficulties, for example, by means of modules 11 (FIG. 5) as and how shown in a preferred embodiment of the invention.

In addition, in another preferred embodiment, in combination or as an alternative to the above, the lighting of arch 5 consists of a series of autonomous lighting elements 7 arranged along said arch 5 and aimed in such a way that they can be seen by a vessel that is approaching the port. The inclusion of said autonomous lighting elements 7, together with an electronic control and supply unit 6, allows these elements 7 to be illuminated with complete flexibility in so far as achieving the differing visual appearances of the arch 5. It is considered that the preferred lighting shape for the marker 1 is an arch shape 5 that has a correlative and sequential switching on and off of the different autonomous lighting elements 7 from the furthest element 8 to the light 4 up to the element that is nearest 9 to said light 4. In this way the final visual effect is that of a light (green or red according to the side of the mouth of the port entrance where the marker 1 is located) which moves along the arch 5 showing the position of obligatory signalling light 3 and/or 4 (in the case illustrated, 4) and, therefore, the location of the left and/or right side if said mouth. It can be stated that signalling of this type (together with the obligatory lamp or lighthouse 3 and 4 and support signalling marker 1 that shows the position of the obligatory lights 3, 4) constitutes an indication that allows for an almost zero margin for error, with which, the objective of the invention is achieved, the providing of an aid for the navigator to locate the mouth of the port entrance easily even in conditions of poor visibility.

The arrangement of the lighting of the autonomous elements 7 and the placing of said elements 7 can vary depending on the criterion of the installers and the relevant authorities without this meaning any novelty for the present invention as can be deduced from the attached claims. The lighting pattern of said elements 7 when working can be programmed or can be selected from amongst a series of programmes incorporated by means of the electronic assembly 6. This electronic assembly 6, which can include the lighting control electronics likewise power electronics for the marker supply 1, it can be located hidden in an internal place within the arch 5, for example, at either of the two ends of the arch 5, and can be accessible via safety door flap. There is also the possibility of said lighting means 2 being entirely controlled from a port control centre, by internal cabling or by means of radiocommunication, without the need to have to personally go to the site of the installation of arch 5. Likewise, the nature of said elements 7 is optional even though in one preferred embodiment of the invention LEDs are chosen (more specifically matrixes of LEDs 12) because of their low consumption, because of the variety of models available on the market and because of the effectiveness shown in multiple and differing devices that are available in the current electronics industry.

In addition, the reduced size of some models of LED makes multiple lighting patterns easy and even the possible broadcasting of messages "drawn" in the LED matrixes 12.

Figure 5:
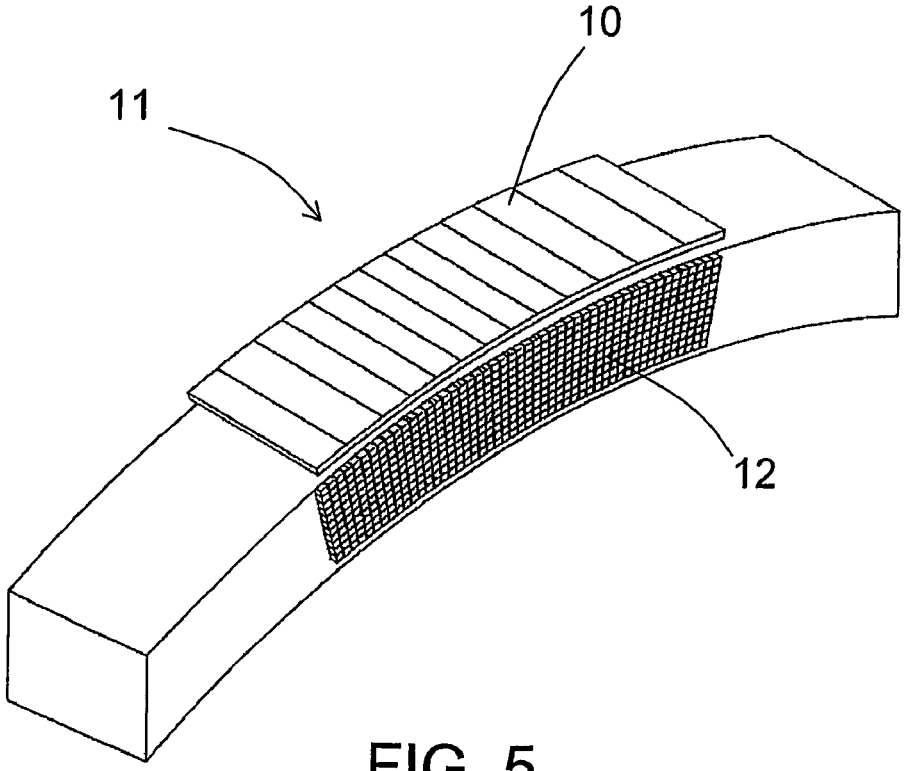
FIG. 5 is a perspective view of an autonomous module that makes up a part of the arch of the marker of this present invention.

In regard to the supply for the internal electronic circuit of the arch 5, in another embodiment the use of solar panels 10 has been chosen with a view to making a saving in electrical energy and considering the position of the marker 1 in a geographical location in which it is normally in a clear place (or at least, in general clearer than inside cities) makes the entry of the solar rays easier for said panels 10. In FIG. 5 it can be seen that one of these solar panels 10 is installed in an autonomous module 11 of the arch 5. The panels 10 can be distributed around the entire surface of the marker 1 according to the energy consumption needs of each installation and can even be used to support other port devices, apparatus or machines. In regard to this characteristic, the transversal section preferred for the arch 5 is quadrangular, with greater preference on rectangular. Likewise, even in this example, the solar panels 10 connect to respective autonomous modules 11, said panels 10 could equally be installed in an embodiment of the marker 1 in which the arch 5 makes an indivisible unit. For example, in sports marinas, the ports of villages and small towns, it may be desirable to install the marker 1, according to the present invention with even more reduced dimensions and, possibly with aims that are more concerned with their appearance than their functions. In such a case it may be more suitable to have an arch 5 as a single piece or, at least, not divisible in both autonomous modules 11 and equally in the previous means of the embodiment.

This aesthetic aim of the marker 1 is another important aspect of the invention in so far as the port for the entrance to a town is the first image of same seen by visitors who arrive by this route. The first impression is fundamental, especially when the town has tourist or recreational interests. For this reason, the design and the shape of the arch 5 allows for differing variations in order to always adapt it to the needs of each port.

Another fundamental aspect to be taken into account in the structure of the arch 5 is the relatively aggressive environment in which it has to be. The atmospheric erosion, the salinity of the sea likewise the possible direct attack from the waves make it advisable to use materials that are resistant to said aggression. In one preferred embodiment of the invention an arch 5 is used that is made up of, at least, stainless steel as the basic material. In regard to the resistance of the marker 1 to attack from the waves it must be highlighted that the shape of the arch 5 has a reduced surface to the attack by the water with which the structural resistance characteristic of said marker 1 is improved.

Even though, as has been stated previously, the dimensions and design of arch 5 can vary, according to the needs of each port, below some data have been supplied for a preferred embodiment of the marker 1. An arch 5 with a maximum height of eight metres is considered and a maximum distance between the ends of thirteen metres. A height distance, for safety, is fixed at four metres. The means of illumination 2 are installed four metres from the floor. This characteristic is aimed at protecting the lighting means 2 from acts of vandalism and aggression from the sea itself or the atmosphere. In this case the formation of the arch 5 is considered with the joint of the four curved pieces of steel, and the steel sheet making the arch 5 with suitable profiles and openings to make the relevant connections for the solar panels 10 and the LED 12 diode matrixes.

Having described the nature of the present invention sufficiently, likewise the method to put it into practice, it is placed on record that all that which does not alter, change or modify its basic principles can be subject to variations in the detail.

The invention claimed is:

1. Port marker (1) of the type which comprises a means of lighting (2), characterized in that:

the marker is intended to be positioned next to an obligatory port navigation light signal in the form of red (3) and green (4) light signals, lighting columns or lighthouses at a port entrance, the marker comprises a self-supporting arch (5) having a maximum height which is essentially greater than the height of the light signal, lighting column or lighthouse of the obligatory port navigation light signal, and it has an electronic unit for powering and controlling (6) the lighting means;

said lighting means are distributed between the two ends of the self supporting arch along the length thereof and are disposed such as to be visible to a boat or similar vessel approaching the port; the colour of said lighting means corresponds to that of the obligatory lighting column, lighthouse or light signal at the entrance to the port, which can be is red or green.

2. Port marker (1), according to claim 1, characterised in that the means of lighting (2) are made up from a series of autonomous elements of consecutive lighting (7), and the electronic assembly (6) of the marker is adapted to providing continuous lighting from said autonomous lighting elements and in a sequential lighting order of same from the element located furthest (8) from the obligatory lighting column, lighthouse or light signal up to the element that is located nearest (9) from the said obligatory lighting column, lighthouse or light signal.

3. Port marker (1), according to the claim 2, characterised in that said autonomous lighting elements (7) are LEDs.

4. Port marker (1), according to the claim 2, characterised in that the electronic lighting assembly (6) is made up of a series of solar panels (10), the lighting means (2) being located on the visible face of the arch (5) on entering into the port, and the solar panels being located on at least one of the remaining faces distributed along the length of the arch.

5. A port marker (1), according to claim 1, characterised in that the self supporting arch (5) is made up from autonomous modules (11), formed by the sections of the self supporting arch and consecutively connected, each one of which likewise constitute a corresponding autonomous lighting element (7).

6. Port marker (1), according to claim 5, characterised in that each autonomous module (11) is made up from a matrix of LEDs (12) on their front face.

7. Port marker (1), according to claim 6, characterised in that each autonomous module (11) has solar panels (10) on the upper face.

8. Port marker (1), according to claim 1, characterised in that the transversal section of the arch (5), is quadrangular on at least the area where the means of lighting means (2) is located.

9. Port marker (1), according to claim 1, characterised in that the transversal section of the arch (5) is rectangular on at least the area where the means of lighting means (2) is located.

10. Port marker (1), according to claim 1, characterised in that the arch material (5) is made from stainless steel.

* * * * *